United States Patent [19]

Mäenpää et al.

[11] Patent Number: 5,009,096

Date of Patent: Apr. 23, 1991

[54] METHOD AND APPARATUS FOR THE REPLACING OF WORKING ROLLS IN A ROLLING MILL

[75] Inventors: Matti Mäenpää; Teuvo Lehtoluoma; Kauko Henttinen; Pertti Jokipalo; Aimo Saren; Seppo Pirinen, all of Hämeenlinna, Finland

[73] Assignee: Rautaruukki Oy, Oulu, Finland

[21] Appl. No.: 454,757

[22] Filed: Dec. 21, 1989

[30] Foreign Application Priority Data

Dec. 22, 1988 [FI] Finland ..... 885953

[51] Int. Cl.[5] ..... B21B 31/07

[52] U.S. Cl. ..... 72/239; 72/237

[58] Field of Search ..... 72/234, 237, 238, 239

[56] References Cited

U.S. PATENT DOCUMENTS

| | | | |
|---|---|---|---|
| 2,829,697 | 4/1958 | Rockhoff et al. | 72/239 |
| 3,376,724 | 4/1968 | Wolfendale et al. | 72/239 |
| 3,396,566 | 8/1968 | Alsop et al. | 72/239 |
| 3,451,244 | 6/1969 | Stover et al. | 72/239 |
| 3,583,195 | 6/1971 | Sherwood | 72/239 |
| 3,979,939 | 9/1976 | Pazderka | 72/239 |
| 4,005,594 | 2/1977 | Reth et al. | 72/239 |

FOREIGN PATENT DOCUMENTS

| | | | |
|---|---|---|---|
| 0154208 | 11/1981 | Japan | 72/239 |
| 0028607 | 2/1982 | Japan | 72/238 |
| 0146410 | 9/1982 | Japan | 72/239 |
| 0212415 | 9/1986 | Japan | 72/238 |
| 1201351 | 8/1970 | United Kingdom . | |
| 1282801 | 7/1972 | United Kingdom . | |
| 2034222 | 6/1980 | United Kingdom . | |

*Primary Examiner*—Lowell A. Larson
*Assistant Examiner*—T. C. Schoeffler
*Attorney, Agent, or Firm*—Spensley Horn Jubas & Lubitz

[57] ABSTRACT

The invention relates to a method for the replacing of working rolls in a rolling mill, wherein there is used a swiveling roll-replacement car which runs adjacent to the working rolls of the rolling mill, on a track parallel to the roll track, and can be aligned with the roll or the roll pair to be replaced. The transfer of the working-roll pair or the working roll from the roll stand to the roll-replacement car and the transfer of a new working-roll pair or working roll from the storage rack to the roll-replacement car take place simultaneously, and the positions of these working-roll pairs or respectively working rolls are interchanged, whereafter there are simultaneously transferred the said new working-roll pair or working roll to the rolling mill and the said old working-roll pair or respectively working roll into the storage rack.

14 Claims, 3 Drawing Sheets

METHOD AND APPARATUS FOR THE REPLACING OF WORKING ROLLS IN A ROLLING MILL

Figure 1:
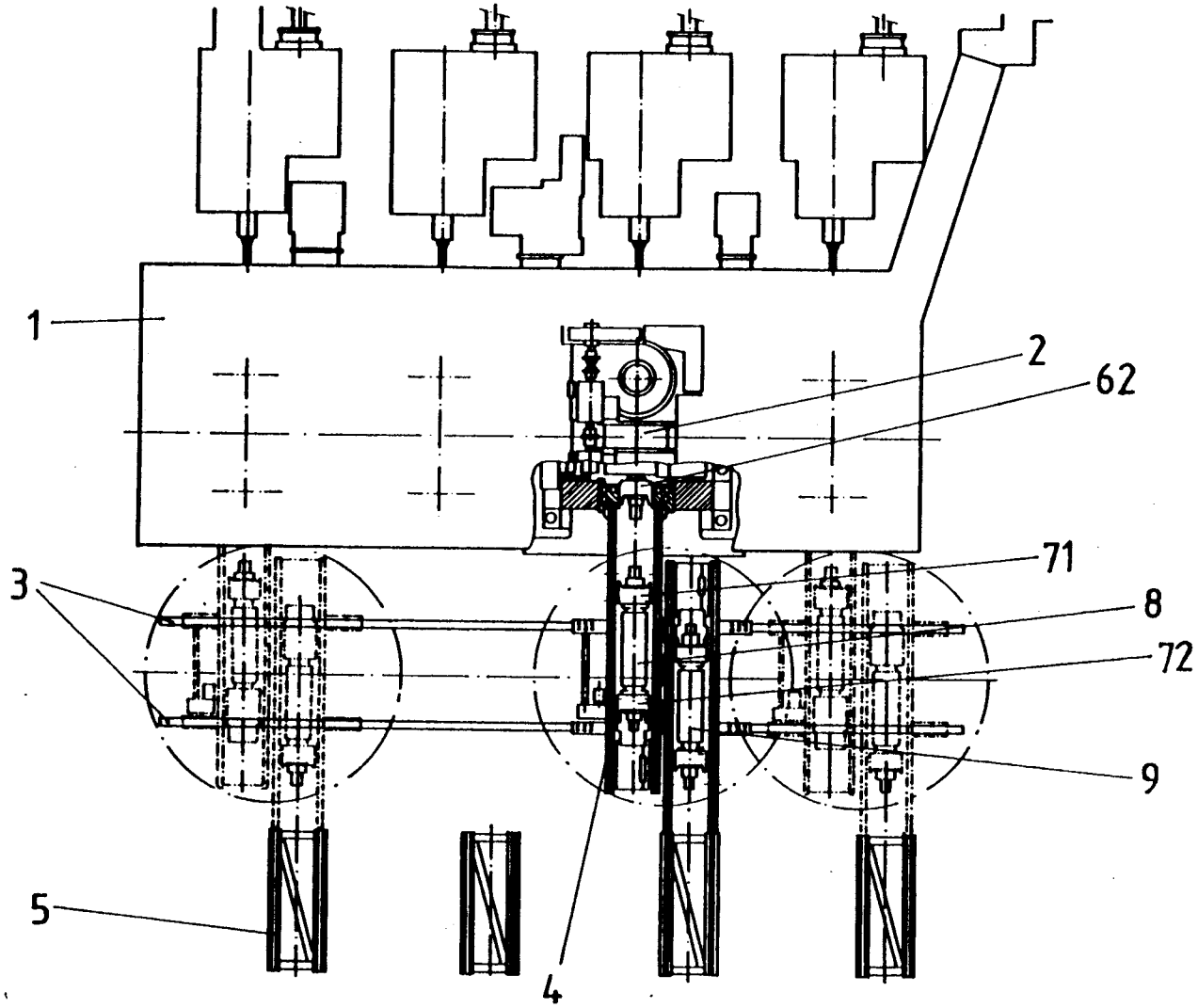

The present invention relates to a method, to be used in the rolling of metal, for replacing working rolls in a rolling mill, and to an apparatus used in the method. The invention relates in particular to a replacing method in which there is used a swiveling roll-replacement car running along a track parallel to the roll track, the car being capable of being aligned with the roll or pair of rolls to be replaced at any given time, and to a corresponding apparatus. The invention has been applied in particular to a multiple-stand sheet rolling mill, and it makes an instant replacing of the working rolls possible.

The working rolls of a rolling mill are replaced regularly because of wear, in addition to which the product to be rolled may damage the rolls, or there may be some other compelling reason for the replacement of one or more rolls or pairs of rolls in the middle of a rolling sequence. Various types of apparatus have been proposed and constructed for the replacing of working rolls; by means of such apparatus the old rolls are removed in pairs from the roll stand and new ones are pushed in. It is a general requirement that the replacement can be carried out rapidly and that the apparatus needed for the replacing should not hinder movement in front of the rolling mill during rolling and should not take up an unreasonable amount of floor space.

The usual system is that each roll stand has its separate roll-replacement apparatus, which for the duration of rolling is shifted backward from its operating position, or in certain systems it is lowered below the floor level. Such roll-replacement apparatuses are very expensive and highly space-consuming in the case of a multiple-stand rolling mill. In another basic system there is used a roll-replacement car which moves, next to the rolling mill, on a track parallel to the roll track and which, stand by stand, removes the used pairs of rolls, makes a swivel and transfer movement, places the pair of rolls in a storage rack, and takes and places, with separate transfer and swivel movements, a new pair of rolls into the roll stand, as disclosed in U.S. Pat. No. 3,979,939. This system is indeed economical in its costs, and it takes up little floor space, but in a multiple-stand rolling mill the replacement of all of the working-roll pairs takes a considerable time because of the several movements of the replacement car.

The object of the present invention is to eliminate disadvantages of prior-art roll-replacement methods by carrying out the replacing of rolls in such a manner that the replacing time used per one roll stand is very short and that the replacement can be carried out using only one roll-replacement car, but also that the total roll-replacement time even in a multiple-stand rolling mill will be reasonably short. A further object is to provide a roll-replacement car which is of a simple structure and therefore reliable in operation.

By the use of the method and apparatus according to the invention, the said objectives are achieved and a substantial improvement is accomplished with regard to the disadvantages described above. In order to achieve this, the method according to the invention is characterized in what is stated in the characterizing clause of claim 1 and the apparatus in what is stated in the characterizing clause of claim 4.

It can be deemed to be the most important advantage of the invention that the roll-replacement time is short, and consequently the costs due to the stoppage of the roll track are low, as compared with the costs involved in the systems according to the state of the art, and that this cost saving is achieved regardless of whether it is the rolls of all or some, or just one of the roll stands of the roll track that is being replaced. It is another advantage of the invention that the roll-replacement apparatus is simple and reliable in operation and that its acquisition price is economical. It is a further advantage of the invention that, with its aid, roll replacement can easily be automated. It is also a considerable advantage of the invention that the same storage rack can be used for both the new roll pair and the roll pair removed from the rolling mill, i.e. by means of the roll replacement car, pairs of rolls are replaced both in the rolling mill and in the storage rack.

Figure 2:
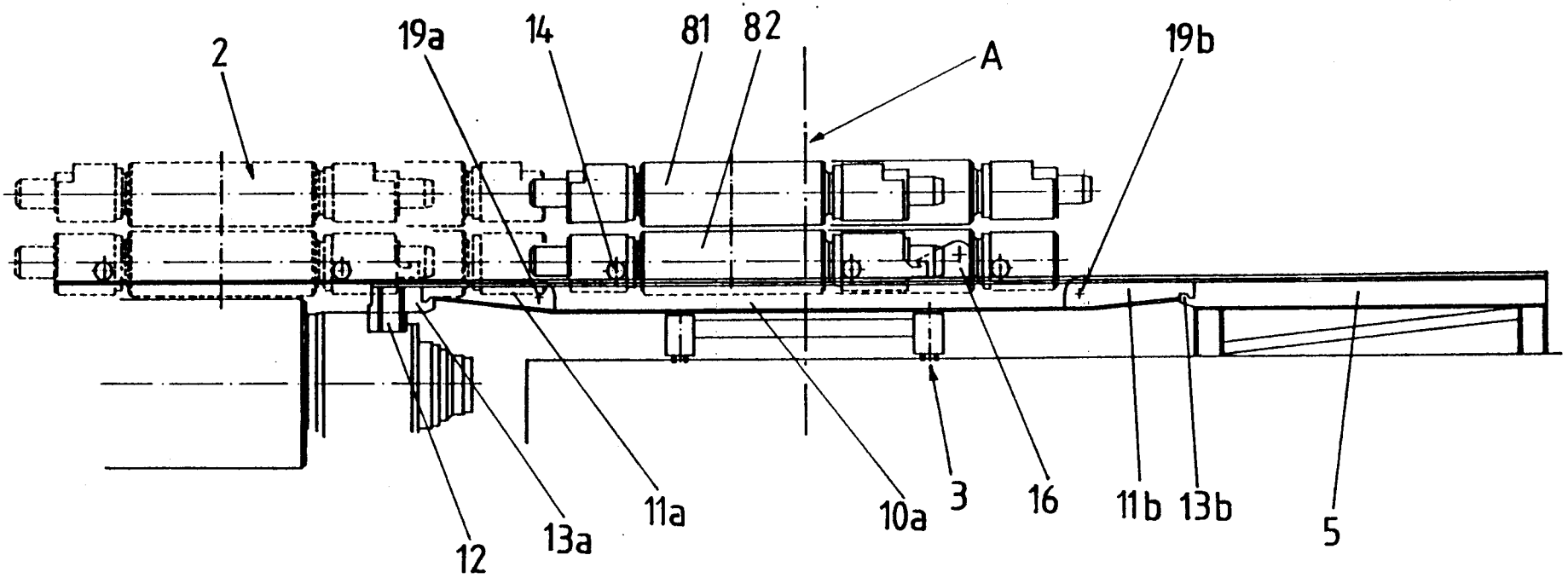
Figure 3:
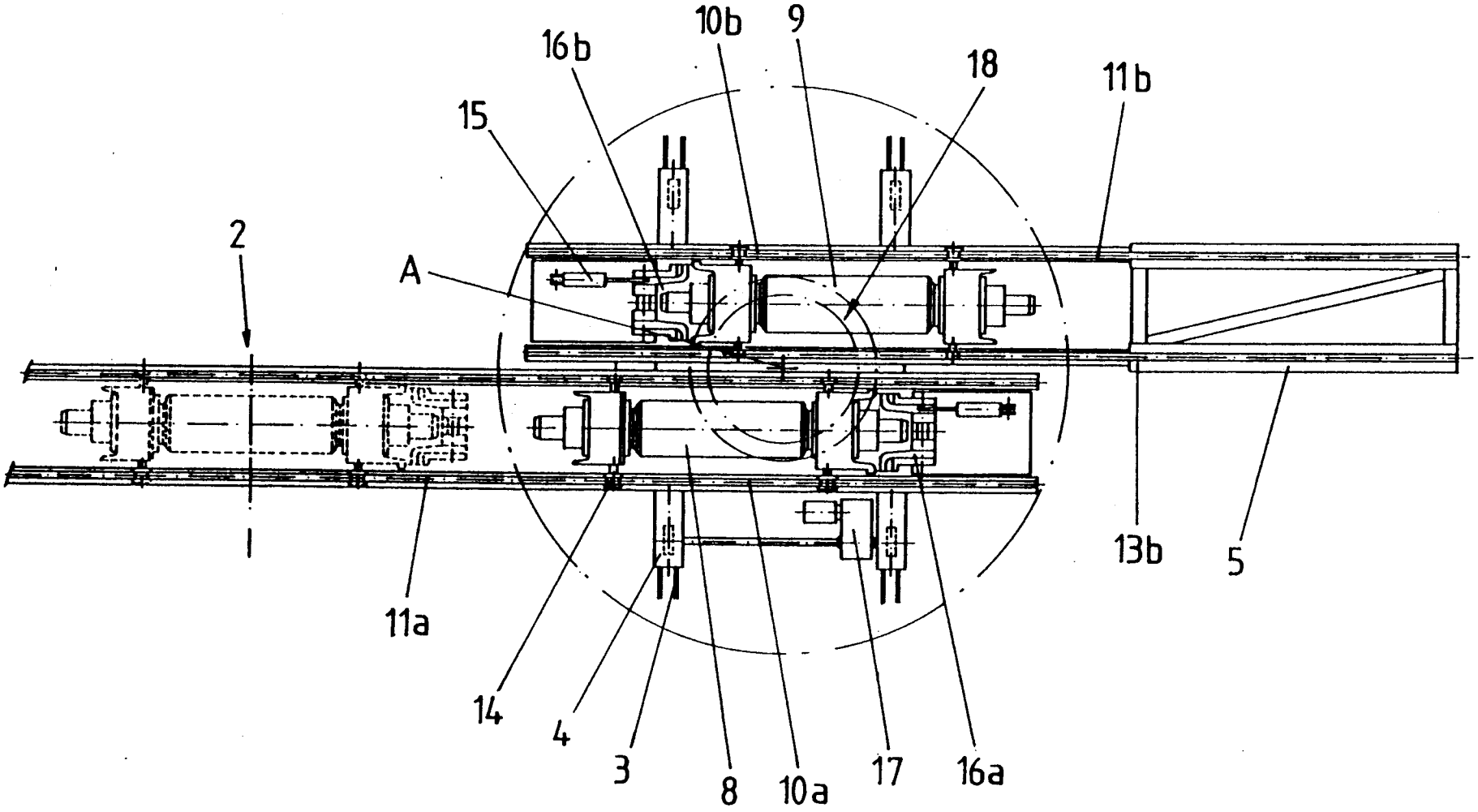

The invention is described below in greater detail, applied to a four-stand sheet rolling mill:

FIG. 1 depicts a plan view of a rolling mill with a roll-replacement apparatus according to the invention, FIG. 2 depicts a roll-replacement apparatus according to the invention, as seen in the direction of the roll track, and FIG. 3 depicts a plan view of the apparatus of FIG. 2.

FIG. 1 depicts schematically, with reference numeral 1, the rolling mill and its drive motors, and, with reference numeral 2, one roll stand in greater detail. At the side of the rolling mill there are rails 3 parallel to the roll track, a roll-replacement car 4 moving on the rails. In addition, the system includes, in front of the rails at each roll stand, storage racks 5 for pairs of rolls. The roll stand 2 is depicted with one of the housing frames sectioned horizontally through the plane of the lower working roll. The figure shows the empty bearing seat 62, from which the bearing arrangement 72 has been withdrawn. Working-roll pairs 8 and 9 can be seen on top of the roll-replacement car 4.

FIG. 2 shows the rolls 81 and 82 of the working-roll pair 8 with their bearing arrangements, supported by a wheeled auxiliary frame 14 on the guides 10*a* in the roll-replacement car 4. The positions of the working rolls in the roll stand are indicated by dashed lines. The guides 10*a* of the car terminate in guides 11*a*, which turn about a hinge mechanism 19*a* and, when turned into the horizontal plane, bear on the guide support 13*a* of the housing frame 12 of the roll stand. At that end of the roll-replacement car 4 which faces the pair of rolls there are grippers for the withdrawing device 16, which is driven by a hydraulic cylinder 15 and transfers the roll pair on guides 10*a* between the roll stand 2 and the roll-replacement car. The figure also shows the turning guides 11*b* of the other guides 10*b* of the roll-replacement car, the guides 11*b* bearing on the guide support 13*b* of the working-roll storage rack 5 and moving about a hinge mechanism 19*b*.

FIG. 3 shows a roll-replacement car 4 which moves on rails 3, driven by drive means 17. The used roll pair 8 withdrawn from the roll stand 2 is on the guides 10*a*, and the new roll pair 9 withdrawn from the storage rack 5 is on the guides 10*b*. The withdrawing of the rolls from the roll stand and respectively from the storage rack take place simultaneously. The guides 10*a* and 10*b* in the roll-replacement car bear on a turning ring 18, shown in the figure suggestively, in such a way that, when the turning guides 11*a* and 11*b* are raised about their hinge mechanisms 19*a*, 19*b* and the guide arrangement is swiveled through half a revolution, i.e. 180°, about the vertical axis A of the turning ring, the guides 10*a* turn into alignment with the storage rack 5, and respectively the guides 10*b* supporting the new pair of rollers, into alignment with the roll stand 2. Thus, in this manner the positions of the new and the used working rolls are interchanged without the necessity of moving the roll-replacement car 4. Thereafter the turning guide parts 11*a* and 11*b* are lowered so that they will now engage the corresponding guide supports 13*b* and 13*a*. Then, by using withdrawal means 16*a* and 16*b*, the new working-roll pair 9 is pushed along the guides 10*b*, 11*b* into the roll stand 2, and simultaneously the used working-roll pair 8 is pushed along the guides 10*a*, 11*a* into the storage rack 5.

The devices on the turning ring 18 of the roll-replacement car are thus located symmetrically in such a way that the rotation of the turning ring about the axis A, always through 180°, produces mutually corresponding positions which all enable rolls or roll pairs to be withdrawn simultaneously from the roll stand and the storage rack or pushed simultaneously into them.

To replace working rollers in a multiple-stand rolling mill, the roll-replacement car 4 is moved so that the guides 10*a* come into alignment with the roll stand, and the guides 10*b* with the first storage rack. The turning guides 11*a* and 11*b* are turned onto the guide supports 13*a* and 13*b*. By using the withdrawing means 16*a* the used working-roll pair 8 is drawn from the roll stand 2 onto the guides 10*a* of the roll-replacement car, and by using withdrawing means 16*b* a new working-roll pair 9 is drawn from the storage rack 5 onto the guides 10*b* of the roll-replacement car. The turning guides 11*a* and 11*b* are raised, and the turning ring 18 is rotated through 180° so that the guides 10*b* come into alignment with the roll stand and the guides 10*a* with the storage rack. The turning guides 11*a* and 11*b* are lowered onto the supports 13*b* and 13*a*, the new working-roll pair 9 is pushed by the withdrawing means 16*b* into the roll stand and the used roll pair is pushed by using the withdrawing means 16*a* into the storage rack 5. The turning guides 11*a* and 11*b* are raised, and the roll-replacement car 4 is driven to the next roll stand and storage rack, and the replacement of the working rolls is carried out correspondingly. After the replacing of the rolls is completed, the roll-replacement car is parked in a storage space provided on the rails 3, for example at the end of the rails, where it does not hamper movement around the rolling mill.

The invention is not limited to the above embodiment, although it is usually the most advantageous. Thus the roll-replacement car may, when necessary, move on some other side of the roll track than on the side which is on the same horizontal level, for example, it may be above it. Likewise, the axis of rotation of the turning ring may be positioned in a manner other than horizontally, which in the embodiment described above means the same as perpendicular to the plane of the roll track or of the rails 3. The axis of rotation may be, for example, parallel to the axles of the rolls, which leads to a "revolver-type" structure. It is to be noted that the rotation of the turning ring 18 through half a revolution, as described above, relates in particular to the fact that the guides 10*a* and 10*b* are fixedly positioned in relation to each other, and especially to the fact that the guides 10*a*, 10*b* are mutually parallel. The other structural details may also vary.

We claim:

1. A method for replacing an installed working roll in a rolling mill having a roll stand receiving the installed working roll, a roll track, a car which runs parallel to the roll track and is alignable with the installed working roll, and a storage rack near the roll stand; the method comprising:

(a) providing a replacement working roll in the storage rack;

(b) providing guiding means, for guiding working rolls, rotatably mounted on the car;

(c) simultaneously transferring the installed working roll from the roll stand and the replacement working roll from the storage rack, to the guiding means;

(d) rotating the guiding means to interchange the positions of the installed and replacement working rolls; and (e) simultaneously transferring the replacement working roll to the roll stand and the installed working roll to the storage rack, from the guiding means.

2. The method of claim 1 wherein the guiding means rotatably bear on a turning ring on the car.

3. The method of claim 1 wherein at step (d) the installed and replacement working rolls are interchanged by rotating the guiding means 180° about a vertical axis.

4. The method of claim 1 wherein at step (d) the installed and replacement working rolls are interchanged by rotating the guiding means 180° about a horizontal axis approximately perpendicular to the direction of the roll track.

5. The method of claim 1 wherein the installed working roll and a installed companion roll are replaced as a pair, further comprising:

also providing a replacement companion roll in the storage rack;

during step (c) also transferring the installed companion roll from the roll stand and the replacement companion roll from the storage rack, to the rotatable guiding means;

during step (d) also interchanging the positions of the installed and replacement companion rolls; and during step (e) also transferring the replacement companion roll to the roll stand and the installed companion roll to the storage rack, from the rotatable guiding means.

6. The method of claim 5 wherein step (d) takes place by rotating the guiding means 180° about a vertical axis.

7. The method of claim 5 wherein step (d) takes place by rotating the guiding means 180° about a horizontal axis approximately perpendicular to the direction of the roll track.

8. In a roll-replacing apparatus for replacing an installed working roll at a rolling mill with a replacement working roll, the rolling mill having a roll stand receiving the installed working roll, and a roll track; and the roll-replacing apparatus having a car running parallel to the roll track to align with the installed working roll, guiding means rotatably mounted on the car for guiding working rolls, moving means for withdrawing the installed working roll from the roll stand onto the guiding means and for pushing the replacement working roll from the guiding means into the roll stand, and a storage rack for the replacement working roll; the improvement to the roll-replacing apparatus comprising that the guiding means include first guide means for transferring the installed working roll from the roll stand to the car and second guide means for transferring simultaneously the replacement working roll from the storage rack to the car, and are mounted so that when rotated over a predetermined angle the first guide means come into alignment for transferring the installed working roll to the storage rack and the second guide means simultaneously come into alignment for transferring the replacement working roll to the roll stand.

9. The improvement of claim 8 wherein the guiding means rotatably bear on a turning ring on the car.

10. The improvement of claim 8 wherein the guiding means are rotatably mounted about a vertical axis approximately midway between the first and second guide means for transferring and the predetermined angle is 180°.

11. The improvement of claim 10 wherein the first and second guide means for transferring are mutually parallel.

12. The improvement of claim 8 wherein an end of the roll stand facing the car has first guide support means, an end of the storage rack facing the car has second guide support means, and the first and second guide means on the car respectively have protruding first and second hinged guide parts which can be simultaneously lowered to horizontal to respectively engage the first and second guide support means.

13. The improvement of claim 8 wherein both the moving means and the first and second guide means are rotatably and symmetrically mounted on the car so that at a first alignment position the first guide means aligns with the roll stand and the second guide means aligns with the storage rack, and at a second alignment position rotated 180° from the first alignment position, the first guide means aligns with the storage rack and the second guide means aligns with the roll stand.

14. The improvement of claim 8 wherein the roll-replacing apparatus can replace the installed working roll and an installed companion roll as a pair with the replacement working roll and a replacement companion roll, further comprising that:

the storage rack is also for holding the replacement companion roll;

the moving means is also for withdrawing the installed companion roll from the roll stand onto the guiding means and for pushing the replacement companion roll from the guiding means into the roll stand;

the first guide means are also for transferring the installed companion roll from the roll stand to the car and the second guide means are also for transferring simultaneously the replacement companion roll from the storage rack to the car; and when rotated over a predetermined angle, the first guide means also come into alignment for transferring the companion installed roll to the storage rack and the second guide means simultaneously also come into alignment for transferring the replacement companion roll to the roll stand.

* * * * *